United States Patent [19]

Schreffler

[11] Patent Number: 4,696,131

[45] Date of Patent: Sep. 29, 1987

[54] EAVES RAIN GUTTER

[76] Inventor: Robert Z. Schreffler, 12817 Richmond St., Chester, Va. 23831

[21] Appl. No.: 914,919

[22] Filed: Oct. 3, 1986

[51] Int. Cl.[4] ..... E04D 13/00

[52] U.S. Cl. ..... 52/11; 248/48.2; 405/119

[58] Field of Search ..... 52/11-16; 248/48.1, 48.2; 405/119; 160/44, 127

[56] References Cited

U.S. PATENT DOCUMENTS

| | | | |
|---|---|---|---|
| 538,108 | 4/1895 | Freeze | 52/11 |
| 1,141,204 | 6/1915 | Noce | 52/11 |
| 2,764,236 | 9/1956 | Dye | 160/127 |
| 3,091,055 | 5/1963 | Hegedusich | 52/16 |
| 3,740,787 | 6/1973 | Bowermaster | 15/105 |
| 4,061,151 | 12/1977 | Ward | 134/33 |
| 4,117,635 | 10/1978 | Nelson | 52/11 |
| 4,406,093 | 9/1983 | Good et al. | 52/11 |
| 4,411,108 | 10/1983 | Kerester | 52/11 |
| 4,446,658 | 5/1984 | Gouin | 52/11 |

FOREIGN PATENT DOCUMENTS

| | | | |
|---|---|---|---|
| 1208272 | 1/1966 | Fed. Rep. of Germany | 405/119 |
| 2713157 | 10/1978 | Fed. Rep. of Germany | 52/11 |
| 28701 | 3/1925 | France | 52/15 |
| 1188288 | 10/1985 | U.S.S.R. | 52/13 |

*Primary Examiner*—John Edward Murtagh
*Assistant Examiner*—Andrew Joseph Rudy
*Attorney, Agent, or Firm*—Norman B. Rainer

[57] ABSTRACT

A rain gutter adapted to be mounted upon the fascia of a building beneath the lowermost extremity of a sloped roof is designed in a manner to easily discharge any accumulated wind-borne debris. The gutter is comprised of a flexible trough having first and second parallel stiffened edge extremities. The first edge extremity is held in fixed position and the second edge extremity is adapted to fall, causing dumping of the contents of the trough. Tether lines control the positioning of the second edge extremity.

6 Claims, 7 Drawing Figures

EAVES RAIN GUTTER

BACKGROUND OF THE INVENTION

This invention relates to rain gutters which are commonly mounted upon the fascia of a building and positioned beneath the lowermost extremity of a sloped roof.

Rain gutters are intended to receive rain water from the roof and direct the water to a downspout which conducts the water away from the foundation of the building. In the course of time however, leaves and other airborne debris accumulate within the gutters to impair their functionality. The removal of debris from the gutter is generally a difficult task involving accident risks inherent in working at precarious heights.

Numerous expedients have been disclosed for preventing entrance of debris into the gutter, or simplifying the removal of accumulated debris. For example, strainer-like devices have been disclosed for emplacement upon the open upper extremity of the trough to prevent entrance of debris. However, such devices themselves become clogged with debris, thereby reducing their effectiveness. Shield devices have been utilized wherein water is conducted around a forwardly directed nose projection that rejects debris. Although relatively low water volumes will travel around such nose projections into an underlying gutter, large flow volumes fail to follow the nose projections and fall directly to the ground as though no gutter were present. Furthermore, many shield devices are of a fragile construction incapable of surviving the weight of a ladder and worker when access to the roof or gutter is sought for periodic maintenance.

Gutter systems have been disclosed wherein gutters of reasonably standard design are pivotably supported by brackets attached to the fascia in a manner permitting controlled inversion of the gutter with consequent dumping of its contents. However, the inversion of such gutters and restoration to their upright functional position generally requires difficult manipulations using a long pole from a location beneath the gutter and in the path of the dumped debris.

It is accordingly an object of this invention to provide an eaves rain gutter which can be easily cleaned of accumulated debris.

It is another object of this invention to provide a gutter as in the foregoing object which permits dumping of accumulated debris without requiring the operator to utilize upward reaching tools or be positioned beneath the gutter.

It is a further object of the present invention to provide a rain gutter of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by an eaves rain gutter for mounting upon the fascia of a building comprising:

(a) an elongated flexible trough having first and second parallel stiffened edge extremities, the first edge extremity being held in fixed horizontal position, and the second edge extremity being movably held in a horizontally disposed water-holding state at an elevation adjacent said first edge extremity and causing said trough to have a sling-like configuration, said second edge extremity being capable of falling freely by gravity to a dumped state wherein the trough is disposed as a vertically oriented substantially flat sheet pendantly supported by said first edge extremity, (b) a plurality of supporting brackets attachable to said fascia and configured to hold said first edge extremity in a fixed horizontal position, and hold said second edge extremity in a releasible horizontal position, (c) a plurality of tether lines interactive with said second edge extremity at horizontally spaced sites thereof and adapted to raise said second edge extremity from its position in the dumped state to its position in the water-holding state, (d) anchoring means for maintaining said tether lines in a fixed position in the water-holding state of the rain gutter, and (e) guide means which slidably engage said tether lines in a manner causing an angular directional change of the tether lines permitting movement of said tether lines in horizontal and substantially vertical directions, whereby (f) force applied to said tether lines in their horizontal directions causes said second edge extremity to be raised from said dumped state to said water-holding state.

In preferred embodiments, the gutter trough is comprised of a single strip of a flexible material such as a sheet of rubber, elastomeric synthetic polymer or fabric which is rendered water-impermeable by virtue of associated polymer material. The edge extremities may be stiffened by attachment to rigid rods or tubes.

The guides are preferably associated with the supporting brackets. Bracing means may be associated with said brackets in a manner to cause shaping abutment of the trough sheet in its water-holding state.

In certain embodiments, the tether lines, in their region of horizontal movement, are gathered as a bundle extending toward one lateral extremity of the gutter trough. In other embodiments the plurality of tether lines may be connected to a single horizontally directed cable.

The first edge extremity is preferably forwardly spaced from the fascia while the second edge extremity is positioned rearwardly from said first edge extremity and closely adjacent the fascia.

BRIEF DESCRIPTION OF THE DRAWING

For a fuller understanding of the nature and objects of the invention, reference should be had to the following detailed description taken in connection with the accompanying drawings forming a part of this specification and in which similar numerals of reference indicate corresponding parts in all the figures of the drawing.

DESCRIPTION OF THE PREFERRED EMBODIMENT

Figure 1:
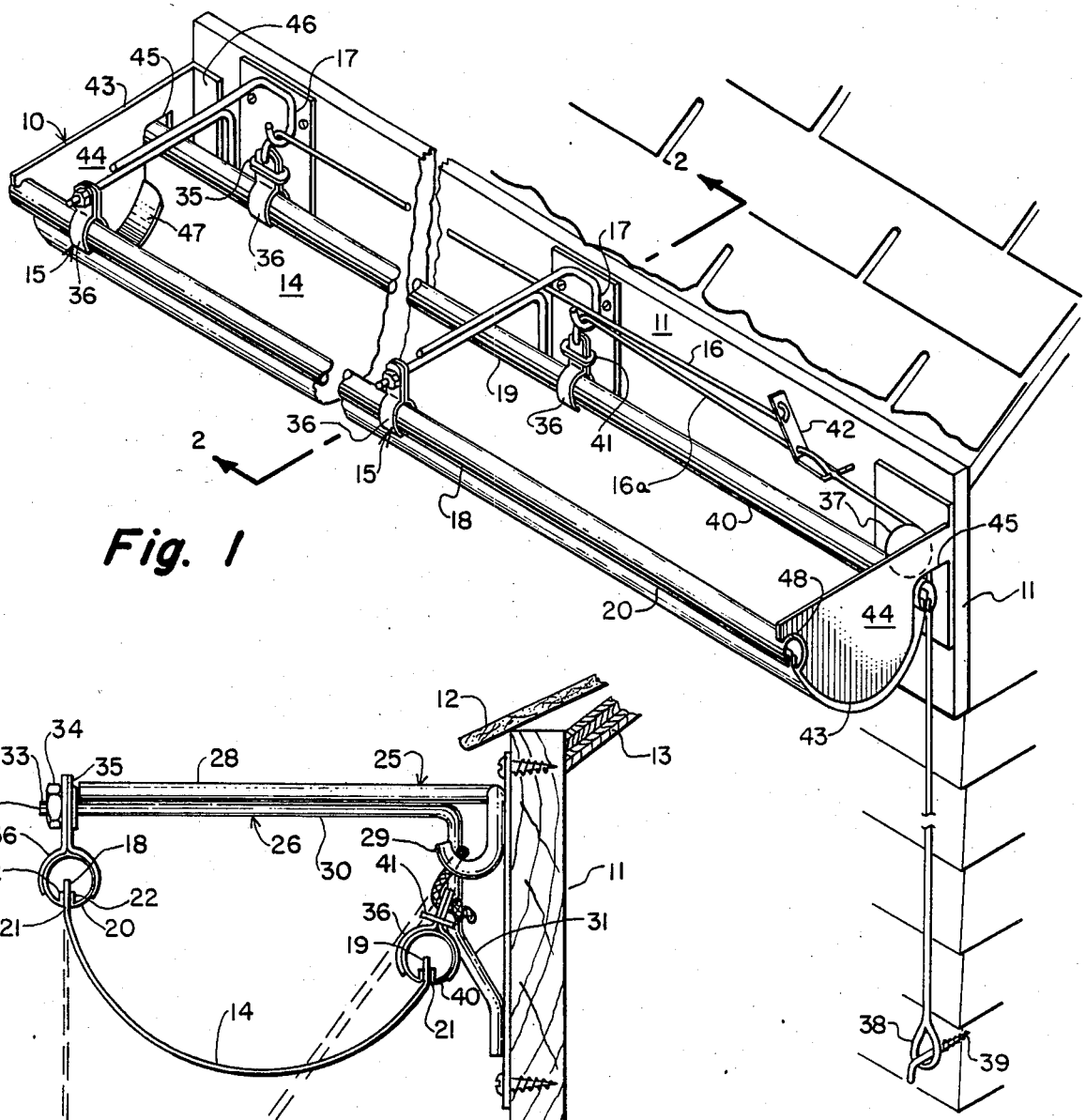
FIG. 1 is a fragmentary perspective view of an embodiment of the rain gutter of this invention, shown in the water-holding state.

Referring to FIG. 1, an embodiment of the rain gutter 10 of the present invention is shown attached to the fascia 11 of a building and positioned below the lowermost edge 12 of roof 13. The intervening space between said edge 12 and fascia 11 is generally referred to as the eaves of the roof structure.

Rain gutter 10 is comprised of flexible elongated trough 14, and a plurality of supporting brackets 15, tether lines 16, and guide means 17. Trough 14 of the exemplified embodiment is fabricated of an integral piece of thin sheet-like material such as rubber, neoprene, polyurethane, silicone, and the like having resistance to weathering, while retaining strength and flexibility over wide temperature extremes. In alternative embodiments however, the trough may be fabricated of two or more rigid elongated panels pivotably interconnected at their long edges to provide a trough of controlled flexibility in the direction normal to the long axes of the panels.

Figure 2:
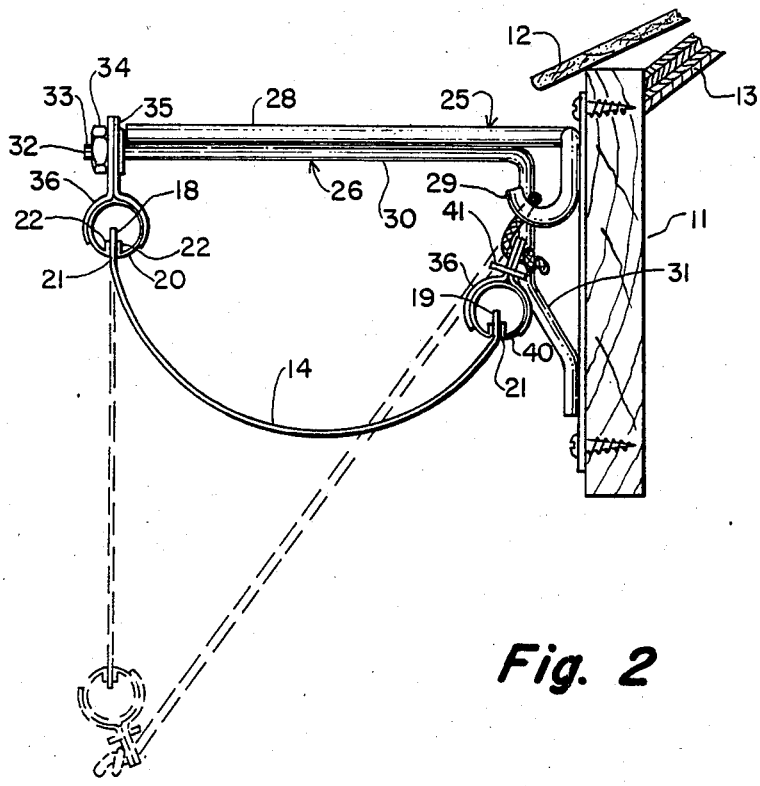
FIG. 2 is a sectional view taken along the line 2—2 of FIG. 1 and showing in phantom outline the dumped state of the gutter.
Figure 3:
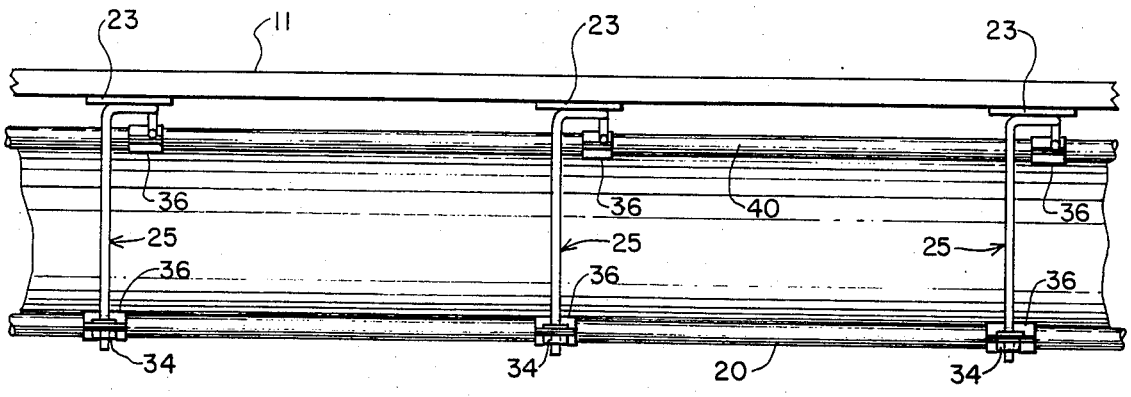
FIG. 3 is a top view of the embodiment of FIG. 1.
Figure 4:
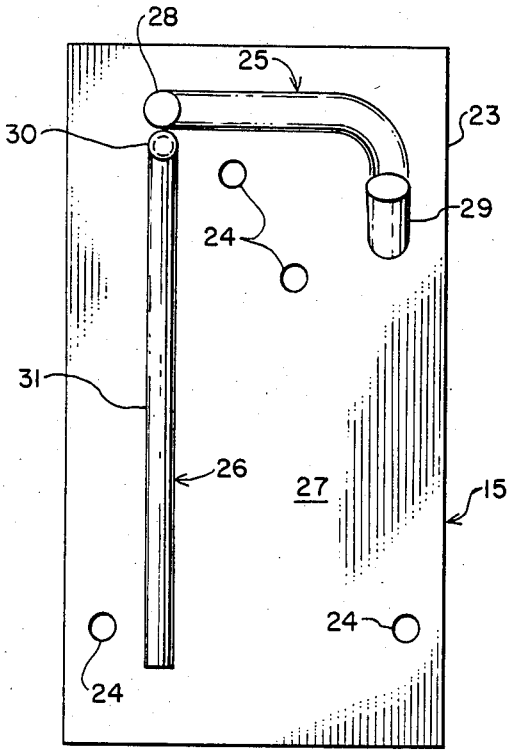
FIG. 4 is a front view of a supporting bracket component of the rain gutter of FIG. 1.
Figure 5:
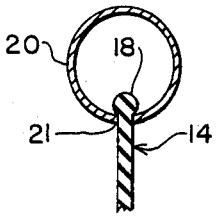
FIG. 5 is an enlarged fragmentary sectional view of an alternative edge construction useful in the rain gutter of FIG. 1.

As best shown in FIG. 2, the trough has first and second parallel edge extremities 18 and 19, respectively, engaged by rigid tubular holding clips 20 and 40, respectively, of generally C-shaped cross-section having spring-like characteristics with respect to the width of downwardly disposed slot 21. Each edge extremity of the trough is inserted into said slot and retentively gripped thereby. To enhance the gripping effect, two vertically disposed facing shoulders 22 extend from slot 21 into the interior of holding clips 20 and 40. In the embodiment exemplified in FIG. 5, the edges of the trough are of enlarged cross-sectional configuration, thereby permitting the trough edges to be slid horizontally onto the holding clip, and obviating the need for spring-like characteristics in the clip. Still other alternative expedients may be employed to cause the edge extremities of the trough to be retained within or by the elongated rigid members.

The exemplified embodiment of supporting bracket 15 has a flat mounting plate 23 having apertures 24 adapted to permit penetration of screws for attachment to fascia 11. Upper and lower bent metal rods 25 and 26, respectively, are affixed to the front face 27 of plate 23 by way of spot welding or equivalent means. Upper rod 25 is comprised of a straight support arm portion 28 disposed horizontally and normal to plate 23, and a hook-shaped guide portion 29 laterally displaced below arm portion 28 and adjacent plate 23.

Lower rod 26 is comprised of extension arm portion 30 disposed below arm portion 28 of the upper rod and welded thereto, and brace portion 31 disposed below said extension arm portion and attached to the front face of plate 23. The forwardmost extremity 32 of extension arm portion 30 extends forwardly of support arm portion 28, and is provided with a threaded section 33 and retaining nut 34. In alternative embodiments, the supporting bracket may be of integral molded construction.

Threaded section 33 is adapted to pass through apertures 35 of paired attachment clamps 36 which embrace holding clip 20 at spaced intervals. As shown in FIG. 2, trough 14 is pendantly supported by said paired attachment clamps when the trough is in its dumped state.

Said paired attachment clamps 36 additionally embrace holding clip 40 at spaced intervals beneath guide portion 29 of each supporting bracket 15. Retainer collars 41 are utilized to hold selected paired halves of attachment clamps 36 together. A tether line 16 is fastened to said selected paired attachment clamps 36 by tied engagement through apertures 35. The tether line extends over the top of guide portion 29 and thence horizontally toward a lateral extremity of the trough. The tether lines may be separate in their extension from the holding clip and thence horizontally to a lateral extremity of the trough, or the several tether lines may join with a single horizontally disposed main trunk line 16*a* as shown in FIG. 1. When a main trunk tether line is used, the separate tether lengths which attach to clamps 36 may be referred to as primary tether lines. Joinder of the tether lines may be achieved by way of joining brackets 42 or by knotting or alternative equivalent means.

Figure 6:
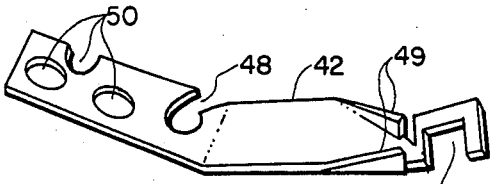
FIG. 6 is an enlarged side view of a joining bracket component of the rain gutter of FIG. 1.
Figure 7:
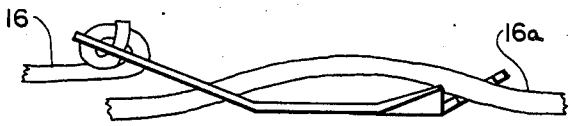
FIG. 7 is a perspective view of the joining bracket of FIG. 6.

A preferred type of joining bracket, illustrated in FIGS. 6 and 7, is shown comprised of an integral piece of bent and machined flat metal stock. Slots 48 and guide wings 49 aid in inserting, locating and adjustably fixing the joining bracket upon a single horizontally directed tether cable 16*a*. Apertures 50 permit the attachment by knotting of the primary tethers 16.

When the tether lines are horizontally drawn, by manual or motorized means, the second edge extremity is elevated from its pendant location to an upper location adjacent mounting plate 23, as shown in FIGS. 1 and 2. To assist in horizontally moving the tether lines, a pulley sheave 37 may be positioned adjacent a lateral extremity of the trough and adopted to rotate in a vertical plane parallel to fascia 11. Tether lines may travel 90 degrees about said sheave and thence downwardly to a location near the base of the building, thereby permitting the operator to pull downwardly upon the tether lines to raise the second edge extremity.

When the second edge extremity is in its raised location, the tether lines may be secured by way of a loop 38 and interactive hook 39 attached to the building. In said manner, the second edge extremity will be held in place. When it is desired to dump the contents of the trough, the tether lines are merely released from engagement with hook 39, and the weight of the trough 14 and holding clip 40 will cause its descent. Alternative means may however be utilized to achieve the desired anchoring of the tether lines with attendant securement of edge extremity 19 in its uppermost position. In the dumped or descended state, the rain gutter system can be further cleaned by a spray of water from a garden hose.

An end cap 43 is associated with each lateral extremity of the trough. The end cap is comprised of a vertically oriented side panel 44 having a rear groove 45 to permit entrance of holding clip 40, a front groove 48 which accommodates holding clip 20, a mounting plate 46 for attachment to the fascia, and a contoured bottom plate 47 against which the trough abuts from below. Appropriate constructions may be readily designed to enable the trough to accommodate outside and inside corners and downspouts.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An eaves rain gutter for mounting upon fascia of a building comprising:

(a) an elongated flexible trough having first and second parallel stiffened edge extremities, the first edge extremity being held in fixed horizontal position, and the second edge extremity being movably held in a horizontally disposed water-holding state at an elevation adjacent said first edge extremity and causing said trough to have a sling-like configuration, said second edge extremity being capable of falling freely by gravity to a dumped state wherein the trough is disposed as a vertically oriented substantially flat sheet pendantly supported by aid first edge extremity, (b) a plurality of supporting brackets attachable to said fascia and configured to hold said first edge extremity in a fixed horizontal position, and hold said second edge extremity in a releasible horizontal position, (c) a plurality of tether lines interactive with said second edge extremity at horizontally spaced sites thereof and adapted to raise said second edge extremity from its position in the dumped state to its position in the water-holding state, (d) anchoring means for maintaining said tether lines in a fixed position in the water-holding state of the rain gutter, and (e) guide means which slidably engage said tether lines in a manner causing an angular directional change of the tether lines permitting movement of said tether lines in horizontal and substantially vertical directions, whereby (f) force applied to said tether lines in their horizontal directions causes said second edge extremity to be raised from said dumped state to said water-holding state.

2. The rain gutter of claim 1 wherein said trough is comprised of a single strip of a sheet of flexible material.

3. The rain gutter of claim 2 wherein the edge extremities are stiffened by attachment to rigid tubes.

4. The rain gutter of claim 1 wherein said guides are associated with the supporting brackets.

5. The rain gutter of claim 1 wherein bracing means are associated with said brackets in a manner to cause shaping abutment of the trough in its water-holding state.

6. The rain gutter of claim 1 wherein the first edge extremity is forwardly spaced from the fascia while the second edge extremity is positioned rearwardly from said first edge extremity and closely adjacent the fascia.

* * * * *